US010368589B2

(12) United States Patent
Read

(10) Patent No.: US 10,368,589 B2
(45) Date of Patent: Aug. 6, 2019

(54) SWADDLING TOWEL

(71) Applicant: Sue-Rose Read, Invermere (CA)

(72) Inventor: Sue-Rose Read, Invermere (CA)

(73) Assignee: Sue-Rose Read, Invermere (CA)

( * ) Notice: Subject to any disclaimer, the term of this patent is extended or adjusted under 35 U.S.C. 154(b) by 379 days.

(21) Appl. No.: 15/202,128

(22) Filed: Jul. 5, 2016

(65) Prior Publication Data

US 2017/0202270 A1 Jul. 20, 2017

(30) Foreign Application Priority Data

Jan. 18, 2016 (CA) ..... 166365

(51) Int. Cl.

| | |
|---|---|
| ***A41B 13/06*** | (2006.01) |
| ***A41D 3/08*** | (2006.01) |
| ***A41D 15/04*** | (2006.01) |
| ***A41D 27/12*** | (2006.01) |
| ***A41D 31/02*** | (2019.01) |
| ***A47K 10/02*** | (2006.01) |
| ***A41D 1/215*** | (2018.01) |

(52) U.S. Cl.

CPC ..... *A41B 13/06* (2013.01); *A41D 1/215* (2018.01); *A41D 3/08* (2013.01); *A41D 15/04* (2013.01); *A41D 27/12* (2013.01); *A41D 31/02* (2013.01); *A47K 10/02* (2013.01)

(58) Field of Classification Search

CPC ..... A41D 1/215; A41D 3/08; A41D 15/04; A41D 27/12; A41D 31/02; A41D 13/04; A47K 10/02; A41B 13/06

USPC ..... 2/69.5

See application file for complete search history.

(56) References Cited

U.S. PATENT DOCUMENTS

| | | | | |
|---|---|---|---|---|
| 3,629,865 | A | 12/1971 | Weiner | |
| 3,693,190 | A * | 9/1972 | Hickling | A41B 13/06 2/69.5 |
| 6,505,367 | B2 | 1/2003 | Griffin et al. | |
| 6,718,554 | B1 | 4/2004 | Langston | |
| 6,868,566 | B2 * | 3/2005 | Gatten | A41B 13/06 2/69 |

(Continued)

FOREIGN PATENT DOCUMENTS

| | | | | |
|---|---|---|---|---|
| CA | 2525052 | A1 | 11/2005 | |
| WO | 2003099048 | A2 | 12/2003 | |
| WO | WO 2014153261 | A2 * | 9/2014 | A47G 9/062 |

*Primary Examiner* — Khaled Annis
*Assistant Examiner* — Dakota Marin
(74) *Attorney, Agent, or Firm* — Down Rachlin Martin PLLC

(57) ABSTRACT

A swaddling towel has a major dimension and a minor dimension and fasteners are provided on the towel for securing the towel around a neck of a caregiver so that the towel may depend from the neck of the caregiver. First and second cooperating fasteners are spaced apart along the minor dimension and third and fourth cooperating fasteners are spaced apart along the major dimension. Securing the towel using the first and second cooperating fasteners, spaced along the minor dimension, results in the towel depending from the neck of the caregiver in the direction of the major dimension, facilitating wrapping of a new-born/baby. Securing the towel using the third and fourth cooperating fasteners, spaced along the major dimension, results in the towel depending from the neck of the caregiver in the direction of the minor dimension, facilitating wrapping of an infant/toddler.

28 Claims, 7 Drawing Sheets

(56) References Cited

U.S. PATENT DOCUMENTS

| | | | | |
|---|---|---|---|---|
| D591,931 | S | 5/2009 | Yenichek | |
| 7,685,648 | B2 | 3/2010 | Kenney | |
| 8,020,217 | B2 * | 9/2011 | Moore | A41B 13/06 2/104 |
| 9,259,041 | B1 * | 2/2016 | Purcaro | A41D 13/04 |
| 10,045,574 | B2 * | 8/2018 | Darnell | A47G 9/062 |
| 2002/0034912 | A1 * | 3/2002 | Curro | B32B 37/144 442/381 |
| 2002/0172797 | A1 * | 11/2002 | Sugawara | A47G 11/006 428/99 |
| 2008/0201882 | A1 * | 8/2008 | Hay | A45C 9/00 15/118 |
| 2011/0035857 | A1 * | 2/2011 | Quintanilla | A41B 13/06 2/52 |
| 2012/0284893 | A1 * | 11/2012 | Sohn | A41D 1/215 2/46 |
| 2013/0333102 | A1 * | 12/2013 | Benvenuti | A41D 13/00 2/459 |

* cited by examiner

SWADDLING TOWEL

RELATED APPLICATION DATA

This application claims the benefit of priority of Canadian Design Patent Application Serial No. 166365, filed Jan. 18, 2016, entitled "Baby Towel," which is incorporated by reference herein in its entirety.

FIELD OF THE INVENTION

This disclosure relates to a swaddling towel. Examples of the disclosure provide a towel which may be arranged to attach to and depend from a caregiver to facilitate swaddling or wrapping of a child with the towel.

BACKGROUND

When bathing a child it is common practice for the caregiver to lift the child from the bath and then wrap the child in a towel. However, lifting the child from the bath will often result in the caregiver becoming wet. Also, safely and securely supporting a wet child while wrapping the child in a towel requires a degree of dexterity and strength. There have been numerous proposals for specialised towel configurations to facilitate such operations. See for example: U.S. Pat. Nos. 7,685,648, 6,718,554, 8,020,217, 6,505,367, CA 2,525,052, WO 03/099048, US 2011/0035857, U.S. Pat. No. 3,629,865, U.S. Pat. No. D591,931.

SUMMARY OF THE DISCLOSURE

According to an aspect of the disclosure there is provided a towel having a major dimension and a minor dimension and fasteners provided on the towel for securing the towel around a neck of a caregiver whereby the towel may depend from the neck of the caregiver, first and second cooperating fasteners being spaced apart along the minor dimension and third and fourth cooperating fasteners being spaced apart along the major dimension.

Securing the towel using the first and second cooperating fasteners, spaced along the minor dimension, may result in the towel depending from the neck of the caregiver in the direction of the major dimension, facilitating wrapping of a new-born/baby. Securing the towel using the third and fourth cooperating fasteners, spaced along the major dimension, may result in the towel depending from the neck of the caregiver in the direction of the minor dimension, facilitating wrapping of an infant/toddler. Thus, the towel provides at least two alternative configurations suitable for children of different ages.

As the towel is secured around the neck of the caregiver there is no requirement for the caregiver to hold the towel, such that certain aspects of the use of the towel may be substantially "hands-free". The caregiver may also position the towel to provide a degree of protection from splashing while bathing, lifting and carrying a child.

The major and minor dimensions may be oblique relative to one another. In one embodiment, the major and minor dimensions may be substantially perpendicular, but in other embodiments may be at any convenient or appropriate angle.

The towel may be rectangular and comprise two major edges and two minor edges. This may provide for efficient use of material and allow the towel to be handled, stored and used in a similar manner to a conventional towel.

The edges of the towel may be rectilinear.

The towel may comprises a minor edge and the first and second fasteners may be provided adjacent the minor edge. The towel may comprise first and second corners and the first and second fasteners may be located adjacent the respective first and second corners. When secured using the first and second fasteners a major portion of the towel may depend from the neck of the caregiver. This may be convenient for wrapping a baby or smaller child being held against the chest of the caregiver by folding the towel around a generally horizontal axis.

The towel may comprise a major edge and the third and fourth fasteners may be provided adjacent the major edge. When secured using the third and fourth fasteners a major portion of the towel may extend generally horizontally across the body of the caregiver. This may be convenient for wrapping a child being held against the chest of the caregiver by folding the towel around one or more generally vertical axes.

The second and third fasteners consist of a single common fastener. This may assist in minimising manufacturing expense and simplifying the construction of the towel.

The towel may comprise a corner and the second and third fasteners may consist of a single common fastener provided adjacent the corner. This may facilitate location of the fastener by the caregiver. This may be particularly advantageous if the fasteners are coupled together while located out of the line of sight of the caregiver as may be the case if the fastener spacing is such that the towel, with the fasteners coupled, cannot be easily passed over the head of the caregiver.

The fasteners may comprise at least one button and at least one loop. Such fasteners may be secured to or formed from the towel material relatively easily and economically. Alternatively, or in addition, other forms of fasteners may be provided. For example, the fasteners may comprise a hook and loop configuration, such as sold under the Velcro trademark.

The towel may be formed of any appropriate material or fabric and may comprise layers or portions of different materials having similar or different properties or characteristics. The towel may include one or more terry cloth layers, for example a bamboo, cotton or microfiber terry. The loops provided in terry cloth facilitate absorption of water. The towel may include one or more flannel layers. A flannel layer may facilitate provision of a degree of insulation. A flannel layer may also provide a surface which facilitates printing on the towel, although this feature may be provided by other materials. In one embodiment the towel comprises a first layer of bamboo baby loop terry and a second layer of cotton flannel. The bamboo baby loop terry absorbs water and has a soft and gentle surface; typically, the towel will be used with the bamboo baby loop terry facing outwards from the caregiver, towards the child. The multiple layers provide enhanced insulation for a child wrapped in the towel, while the cotton flannel facilitates transfer of body heat from the caregiver to the child.

A particular example of the towel has a rectangular form and comprises two major edges, two minor edges and four corners. At least three fasteners are provided on the towel for securing the towel around a neck of a caregiver whereby the towel may depend from the neck of the caregiver. A corner fastener is located adjacent one of the corners of the towel, a major edge fastener is located on one of the major edges for cooperating with the corner fastener, and a minor fastener is located on one of the minor edges for cooperating with the corner fastener.

A further aspect of the disclosure relates to a towel comprising a first layer and a second layer, the first layer comprising viscose bamboo rayon and the second layer comprising cotton.

Further aspects of the disclosure relate to the use of the towel. One aspect relates to a method of using a towel having a major dimension and a minor dimension and first and second cooperating fasteners spaced apart along the minor dimension and third and fourth cooperating fasteners spaced apart along the major dimension, the method comprising at least one of: securing the towel around the neck of a caregiver using the first and second fasteners such that at least a portion of the towel depends from the neck of the caregiver in the direction of the major dimension; and securing the towel around the neck of a caregiver using the third and fourth fasteners such that the towel depends from the neck of the caregiver in the direction of the minor dimension.

The towel may also be secured around the neck of a child using the first and second fasteners to form a cape.

The towel may also be secured around the neck, shoulder or upper arm of a nursing mother to provide a nursing cover.

The towel may be hung using one of the fasteners.

Another aspect of the disclosure relates to a method of swaddling a child in a towel having a major dimension and a minor dimension, and first and second cooperating fasteners spaced apart along the minor dimension and third and fourth cooperating fasteners spaced apart along the major dimension, the method comprising: (a) securing the towel around the neck of a caregiver using the first and second fasteners such that at least a portion of the towel depends from the neck of the caregiver in the direction of the major dimension and lies against the caregiver's chest; (b) securing the towel around the neck of a caregiver using the third and fourth fasteners such that the towel depends from the neck of the caregiver in the direction of the minor dimension and lies against the caregiver's chest; (c) placing the child against the towel on the user's chest; (d) folding the towel around the child while secured around the caregiver's neck; (e) separating the fasteners around the caregiver's neck; and (f) moving the child away from the caregiver while wrapped in the towel: wherein either of said securing steps (a) and (b) are performed before the other and performance of said securing steps (a) and (b) is spaced apart in time with any of steps (c)-(f) intervening.

Following step (a), step (d) may further comprise folding a lower portion of the towel around the child.

Following step (b), step (d) may further comprise folding a lateral edge of the towel around the child.

Following step (b), step (f) may further comprise lowering the child onto a surface with the child in a standing position.

The method may further comprise: (g) securing the towel around the neck of the child using the first and second fasteners such that at least a portion of the towel depends from the neck of the child in the direction of the major dimension and lies against the child's back to form a cape.

The method may further comprise: (h) securing the towel around one of the neck, shoulder and upper arm of a nursing mother to provide a nursing cover.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 2:
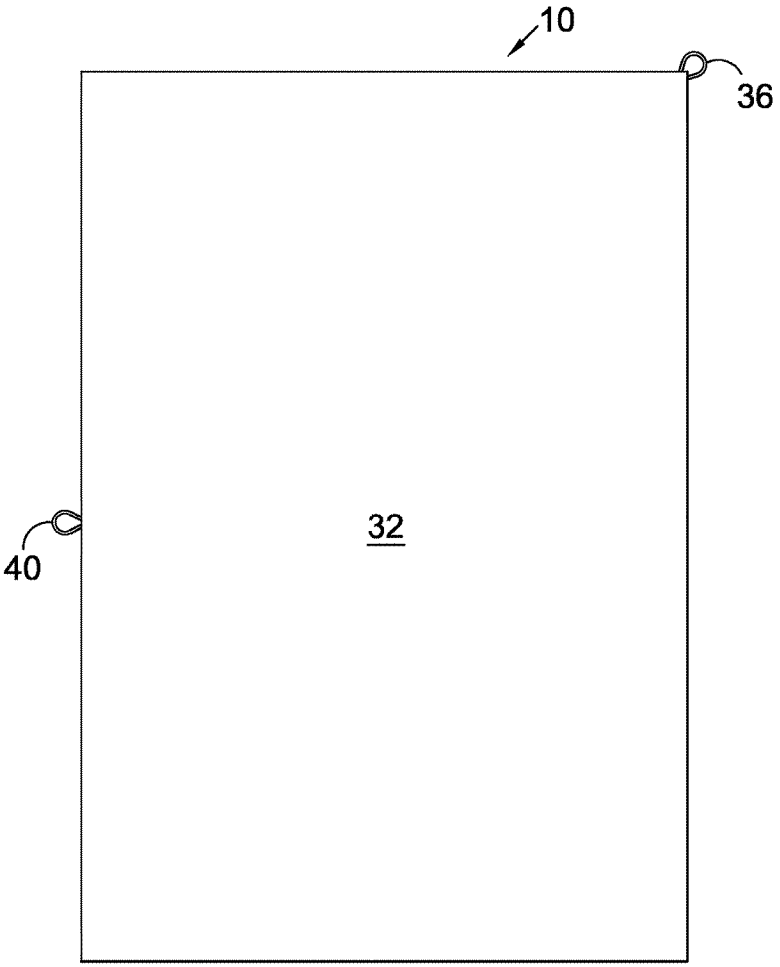
FIGS. 1, 2, 3, 4, 5 and 6 are views of a towel of the present disclosure.

Reference is first made to FIGS. 1 to 6 of the drawings which illustrate a towel 10 of the present disclosure. The illustrated towel 10 is rectangular, that is the towel has a width or minor dimension 12 and two short edges 14, 16, a length or major dimension 18 and two long edges 20, 22, and first, second, third and fourth corners 24, 26, 28, 30. The towel 10 may be of any appropriate dimensions or proportions, but is typically approximately 30 inches wide by 43 inches long or approximately 35 inches wide by 55 inches long. Other towels may be, for example, 30 inches wide by 55 inches long The illustrated towel 10 comprises two layers of fabric: a terry cloth layer, for example a bamboo baby loop terry layer 32, and a cotton flannel layer 34. The bamboo baby loop terry layer 32 may be of, for example, a blend of bamboo and cotton yarn, and may incorporate other textile fibres. In one example the layer 32 comprises 70% viscose bamboo rayon, 27% cotton and 3% elastane or spandex. The layer 32, 34 are secured together by any suitable means, typically by stitching.

The towel 10 may be left undyed or may coloured or patterned as desired. The cotton flannel layer 34 may be printed with any desired pattern, for example: a pattern having a baby or bath-time theme, which may be boy, girl or gender-neutral themed; a pattern or theme associated with a book, TV, film or game, or associated characters; colours or patterns associated with sports teams or events; and colours or patterns associated with a brand or trademark, facilitating provision of promotional or "sponsored" towels.

If desired, only the visible, outer face of the cotton flannel layer 34 may be printed with a pattern or design. The bamboo baby loop terry layer 32 will thus cover the inner face of the cotton flannel layer 34 and conceal the "reverse" of the printed image which might otherwise have been visible when viewing the non-printed face of the layer 34.

The illustrated towel 10 comprises three fasteners: a loop 36 provided adjacent the first corner 24, a button 38 adjacent the second corner 26, and a loop 40 on the long edge 20 between the second and third corners 26, 28. As will be described, the button 38 may be coupled with a selected one of the loops 36, 40, allowing the towel 10 to be attached around a caregiver's neck. In the illustrated example the button 38 extends from the cotton flannel layer 34, but in other examples could be provided to extend from the bamboo baby loop terry layer 32. Furthermore, other examples could feature fasteners on alternative combinations of corners and edges, or indeed on all corners and edges.

Figure 7:
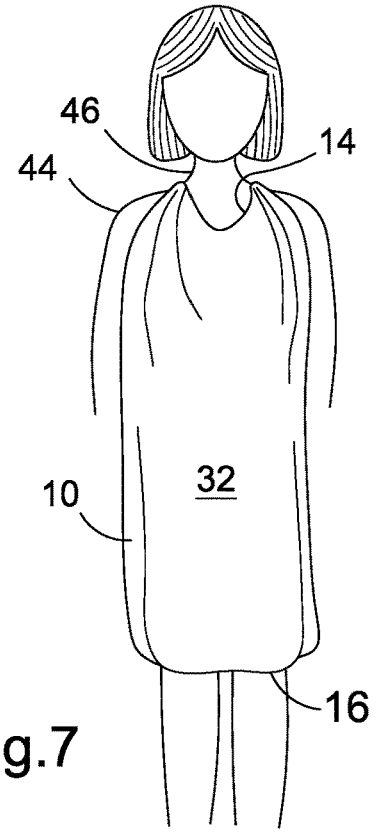
FIGS. 7, 8, 9 and 10 illustrate the towel of FIG. 1 being used in a first configuration to wrap a baby.

Reference is now made also to FIGS. 7 to 10 of the drawings, which illustrate the towel 10 being used in a first configuration to wrap a new-born baby 48. FIG. 7 shows a caregiver 44 who has placed the short edge 14 around their neck 46 and secured the corner loop 36 to the button 38, with the bamboo baby loop terry layer 32 facing outwards. The towel 10 may thus hang substantially vertically against the caregiver's chest and be arranged to cover the front of the caregiver's body and clothing. The caregiver's hands are free to, for example, lift the baby 48 into a bath and support and wash the baby. During bath time the towel 10 protects the caregiver's clothes from splashing.

When bathing is finished, the baby 48 may be lifted by the caregiver 44, again using both hands, and placed on the towel 10 against the caregiver's chest. The wet baby 48 will be placed on the soft moisture-wicking bamboo baby loop terry layer 32. Any water which passes through the layer 32 is absorbed by the cotton flannel layer 34, thus protecting the caregiver's clothing.

Figure 8:
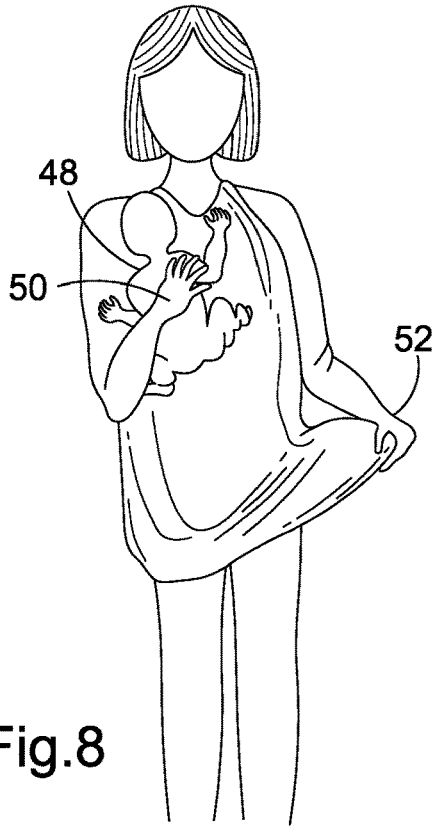
Figure 9:
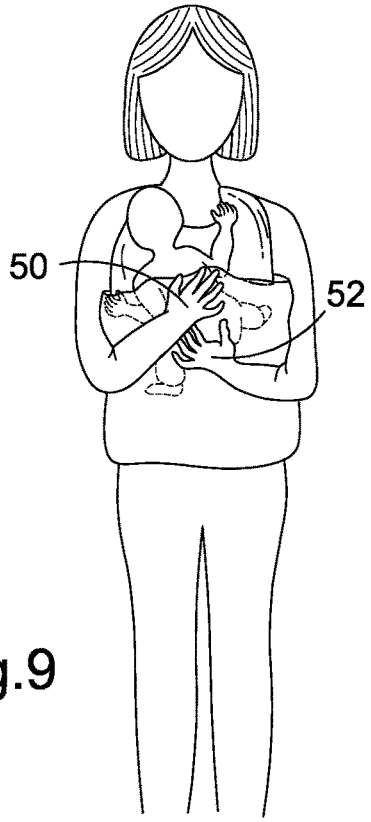
Figure 10:
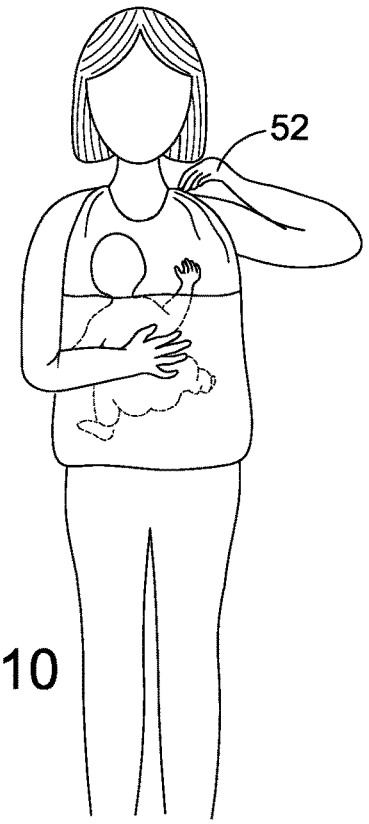

Using one hand (in the drawings the right hand 50) the caregiver 44 may continue to support and hold the baby 48 against their chest while using their other hand (in the drawings the left hand 52) to grasp the lower short edge 26, as illustrated in FIG. 8. The lower edge 26 may then be lifted to fold the towel 10 around the baby 48 and held on the baby 48 with the left hand 52. While supporting the baby 48 now wrapped in the towel 10 with the left hand 52, the right hand 50 may be brought to the outside of the bundle, as illustrated in FIG. 9. The wrapped baby 48 may then be supported and held against the chest with the right hand 50 while the left hand 52 is used to unfasten the loop 36 and button 38, as illustrated in FIG. 10.

The wrapped baby 48 may now be handled and supported using both hands 50, 52. For example, the wrapped baby may be lowered onto a safe supporting surface to be dried.

Figure 1:
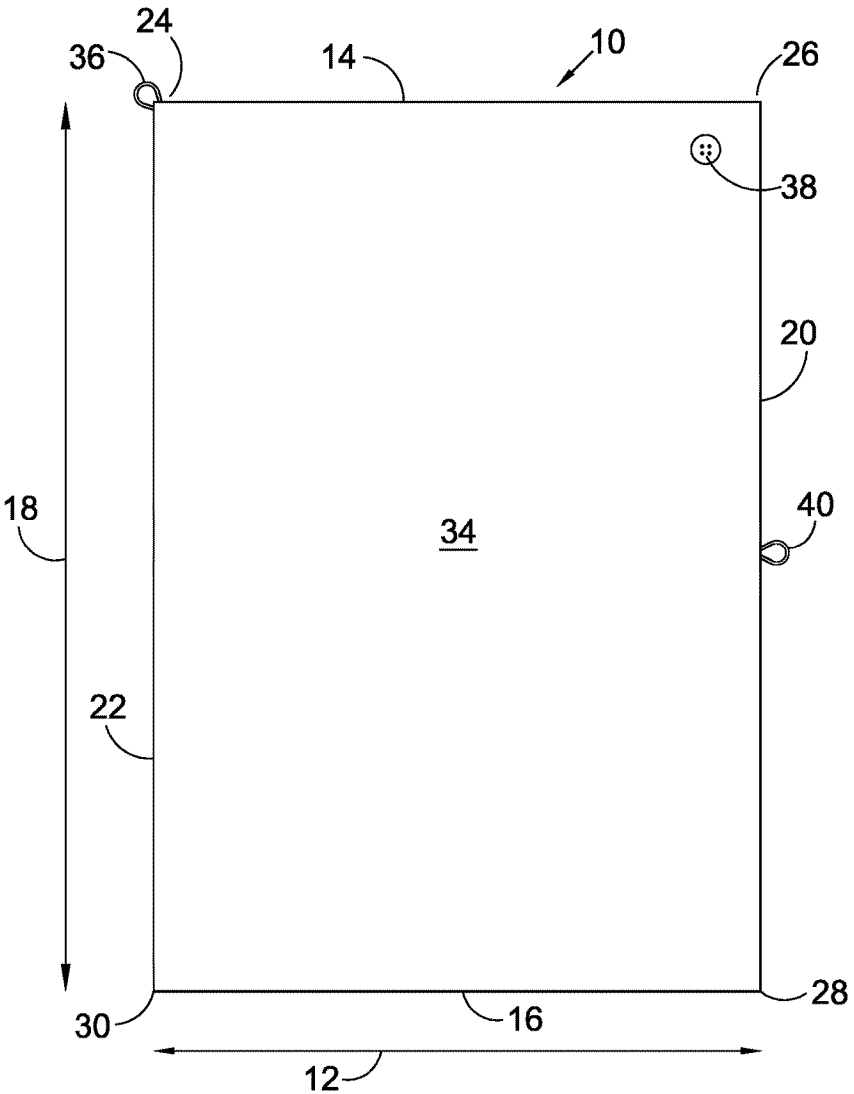
Figure 3:
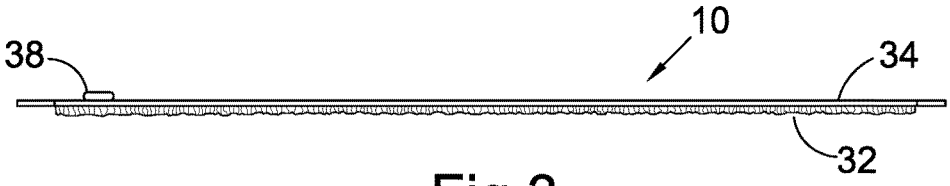
Figure 4:
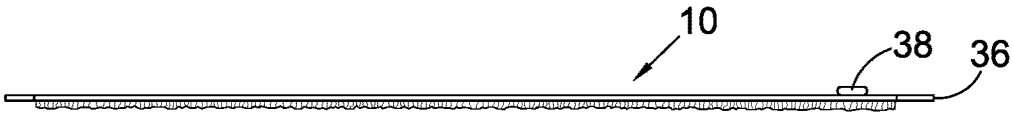
Figure 5:
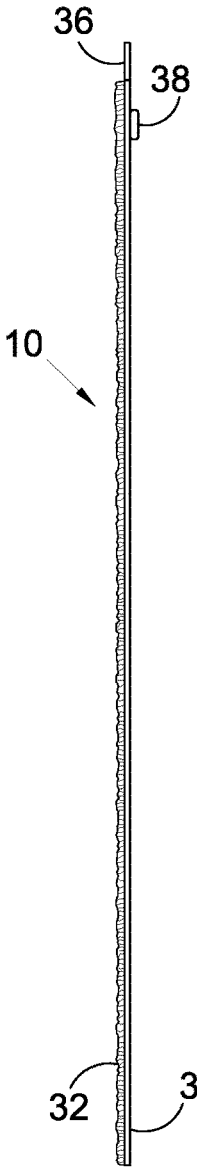
Figure 6:
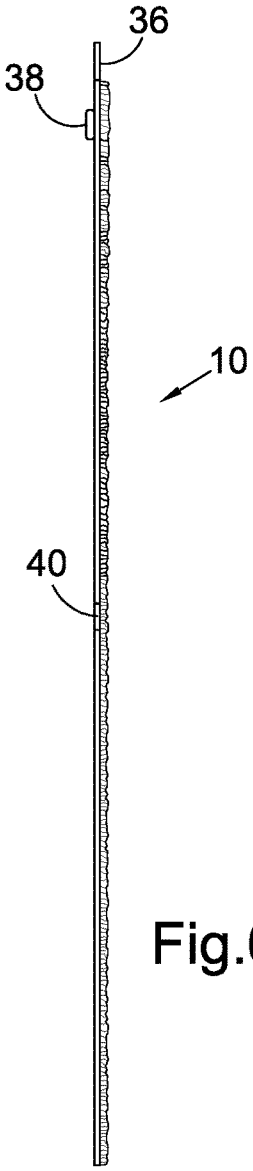
Figure 11:
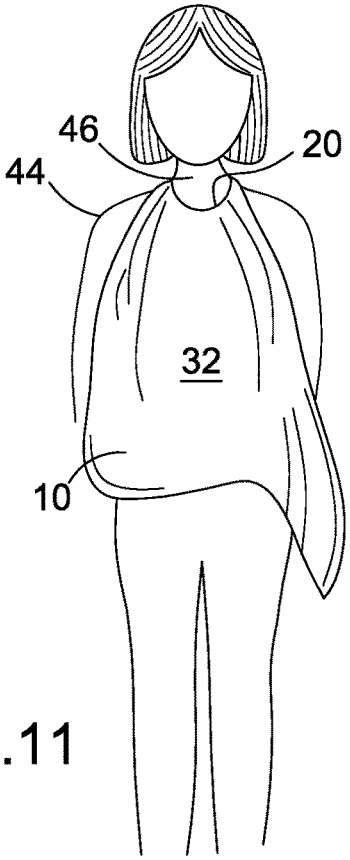
FIGS. 11, 12 and 13 illustrate the towel of FIG. 1 being used in a second configuration to wrap a toddler.
Figure 12:
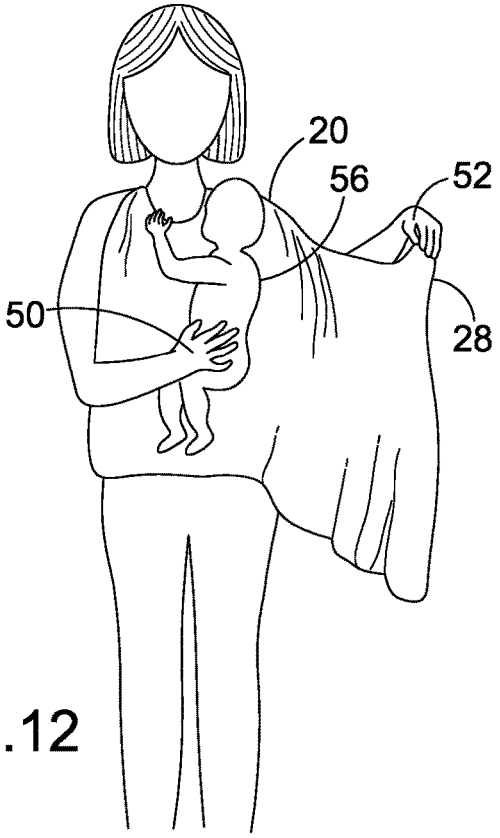
Figure 13:
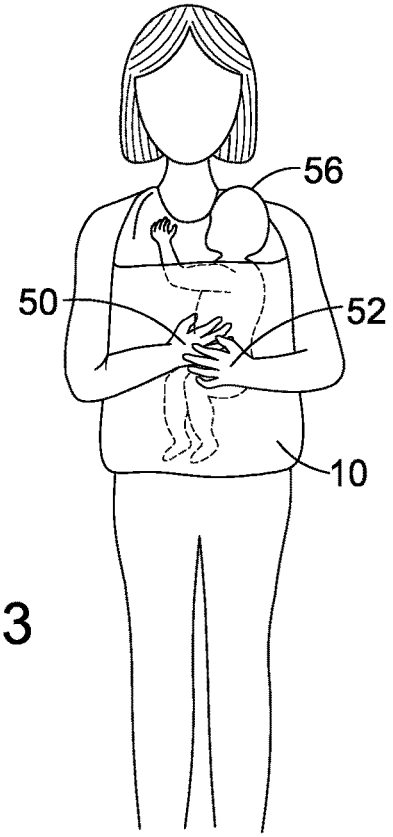

Reference is now also made to FIGS. 11 to 13 of the drawings, which illustrate the towel 10 of FIG. 1 being used in a second configuration to wrap an infant or toddler 56. FIG. 11 shows the caregiver 44 having placed the long edge 20 of the towel 10 around their neck 46 and secured the long edge loop 40 to the button 38, again with the bamboo baby loop terry layer 32 facing outwards. The towel 10 may thus hang against the caregiver's chest with the minor dimension 12 extending generally downwards and the major dimension 18 extending generally horizontally. As with the first configuration, the caregiver's hands 50, 52 are free to, for example, lift, support and wash the toddler 56, while the towel 10 protects the caregiver's clothes.

As with the first configuration, the bathed child 56 may be lifted by the caregiver 44, using both hands, and placed on the towel 10 against the caregiver's chest. Again, the wet child 56 will be placed on the soft moisture-wicking bamboo baby loop terry layer 32.

Using one hand (in the drawings the right hand 50) the caregiver 44 may continue to support and hold the child 56 against their chest while using their other hand (in the drawings the left hand 52) to grasp the third corner 28, as illustrated in FIG. 12. The towel 10 may then be folded around the child 56 and held on the child 56 with the left hand 52. While supporting the child 56 now wrapped in the towel 10 with the left hand 52, the right hand 50 may be moved to the outside of the bundle, as illustrated in FIG. 13. The wrapped child 56 may then be supported and held against the chest with the right hand 50 while the left hand 52 is used to unfasten the loop 40 and button 38.

The wrapped child 56 may now be handled and supported using both hands 50, 52. As the child's feet are not wrapped from below by the towel 10, the wrapped child 56 may be lowered onto a suitable surface, to be dried in a standing position.

Figure 14:
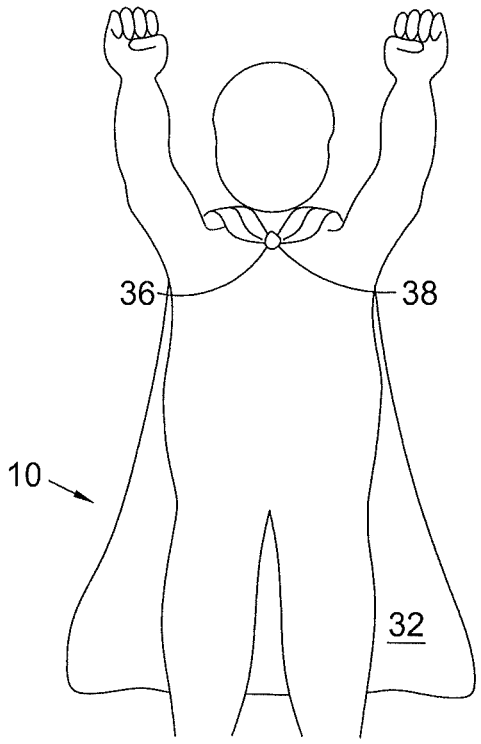
FIGS. 14 and 15 illustrate the towel of FIG. 1 being used as cape.
Figure 15:
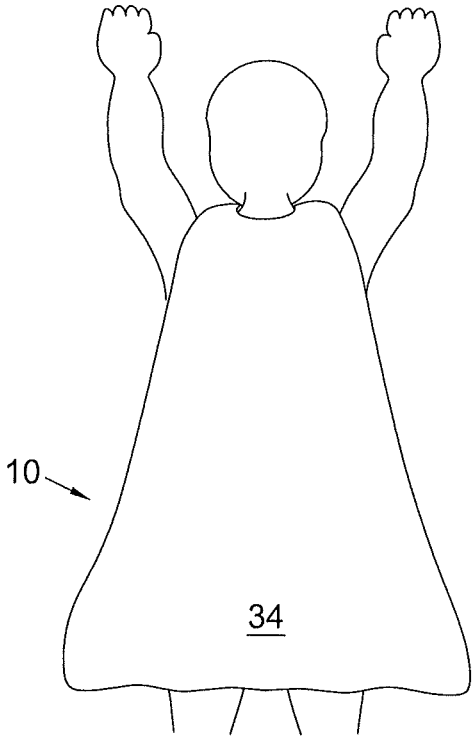

If preferred, the child may be lifted from the bath directly to a supporting surface, such that the caregiver always holds and supports the child with both hands. The towel 10 may be wrapped around the child 56, and the loop 40 and button 38 unfastened, once the child is standing. Alternatively, or in addition, the loop 36 and button 38 may then be fastened to the front of the child's neck such that the towel 10 lies against the child's back to allow the child to wear the towel 10 as a cape (as noted above, the towel 10 may be printed to give the appearance of a "superhero" cape), as illustrated in FIGS. 14 and 15 of the drawings.

The ability to use the towel 10 in different configurations allows a caregiver to use the towel 10 in the first configuration for a newborn or baby, and in the second configuration for an infant or toddler. Thus, the towel 10 may be used for a single child, and the method of using of the towel changes as the child grows. Alternatively, or in addition, the towel 10 may be used as appropriate in a situation where a number of children of different ages are present, for example in a family with two or more children.

After use, one of the loops 36, 40 may be used to hang the towel 10 from a coat or storage hook.

Of course the towel 10 may be used to dry the baby or child, facilitated by the absence of additional pieces, such as hoods, apron-style ties, bib clasps and the like.

Figure 16:
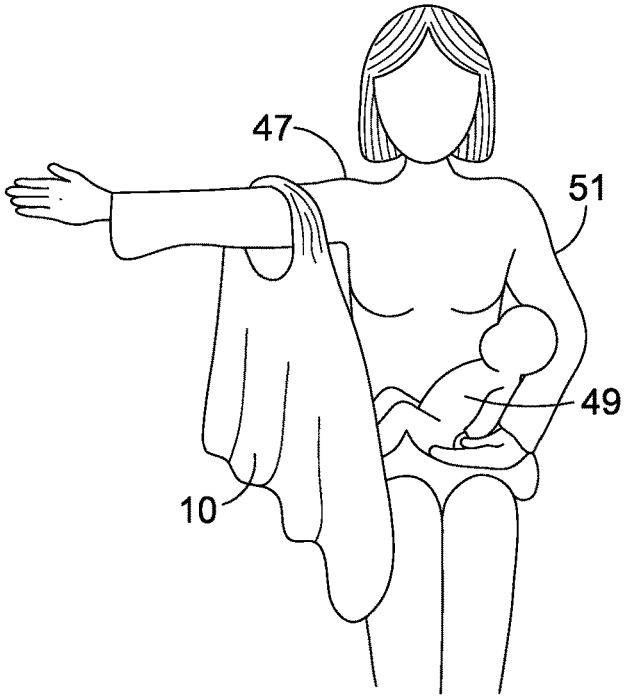
FIGS. 16, 17 and 18 illustrate the towel of FIG. 1 being used as a nursing cover.
Figure 17:
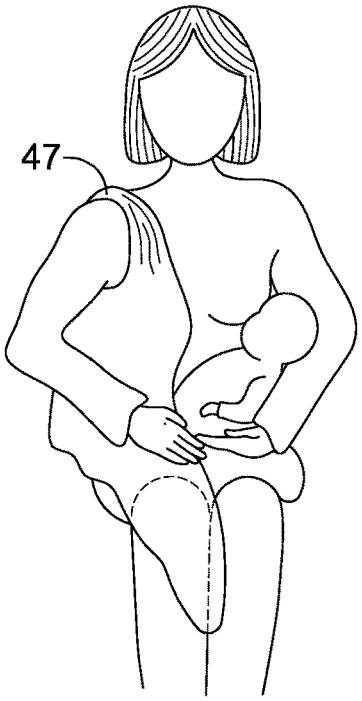
Figure 18:
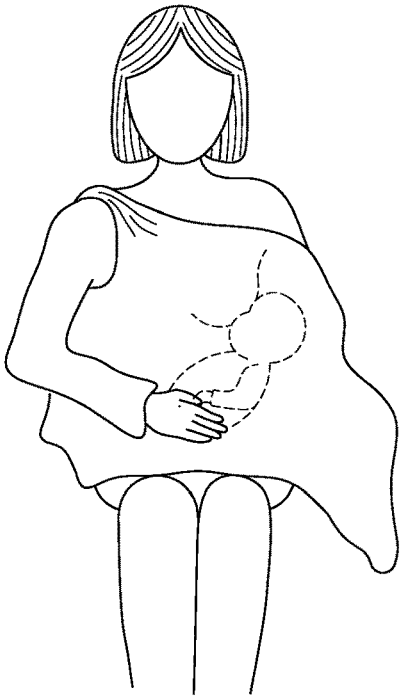

The absence of any attachments also facilitates safe use of the towel 10 as a blanket. Further, the towel 10 may also be utilised as a nursing cover, as illustrated in FIGS. 16, 17 and 18 of the drawings; the loop 40 and button 38 may be clasped around the mother's neck 46 or shoulder 47 (as illustrated) and the free-hanging portion of the towel 10 used to cover the nursing child 49, the front of the mother's body and the arm 51 supporting the child.

The above description relates to the use of the towel 10 by a lone caregiver. However, the towel 10 may be used by a caregiver receiving assistance from one or more other caregivers. Another caregiver may, for example, assist with one or more of: lifting of the child from the bath; placing the child against the towel on the caregiver's chest; folding the towel around the child; fastening and unfastening the loops and button, and in placing the child wrapped in the towel on a supporting surface. Of course the other caregiver may be provided with a second towel in accordance with the disclosure.

Figure 19:
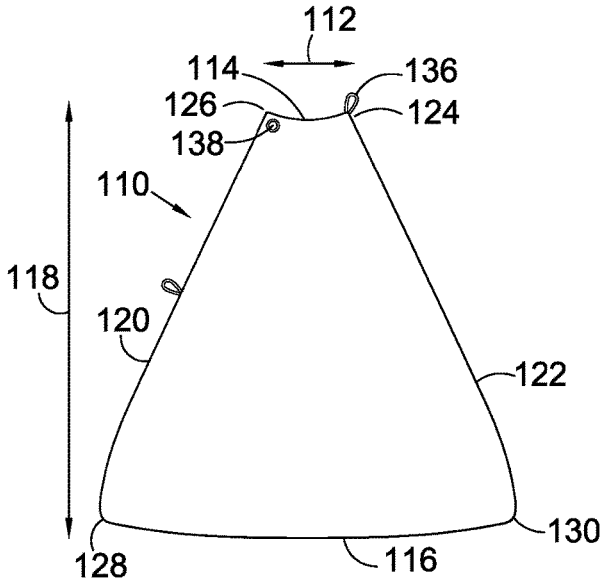
FIGS. 19, 20, 21 and 22 show alternative towel configurations.
Figure 20:
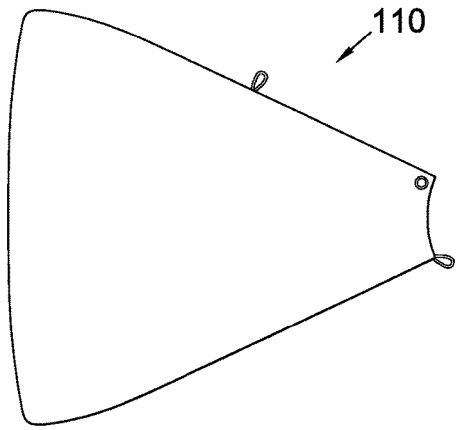
Figure 21:
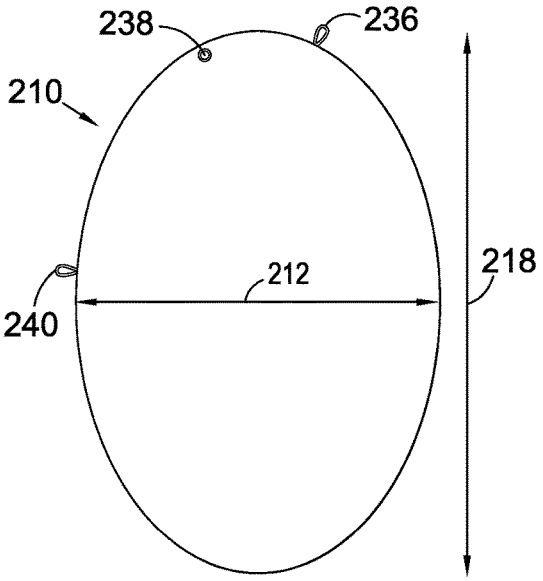
Figure 22:
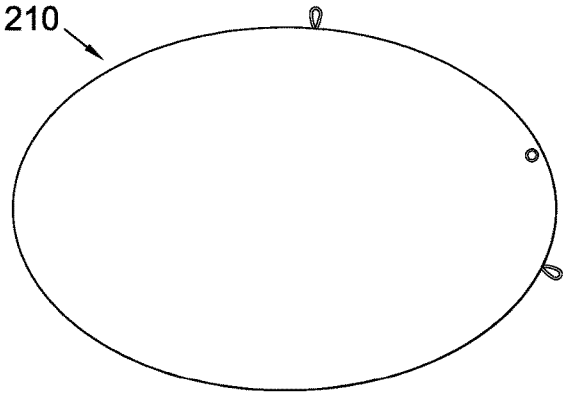

FIGS. 19 to 22 show alternative towel configurations. In particular, FIGS. 19 and 20 illustrate a towel 110 of a generally isosceles trapezoid form. The towel 110 has a width or minor dimension 112 and two shorter edges 114, 116, a length or major dimension 118 and two long edges 120, 122, and first, second, third and fourth corners 124, 126, 128, 130.

The towel 110 comprises three fasteners: a loop 136 adjacent the first corner 124, a button 138 adjacent the second corner 126, and a loop 140 on the long edge between the second and third corners 126, 128. As with the first example, the button 138 may be coupled with a selected one of the loops 136, 140, allowing the towel 110 to be attached around a caregiver's neck in two alternative configurations.

The button 238 may be coupled with a selected one of the loops 236, 240, allowing the towel 210 to be attached around a caregiver's neck in two alternative configurations. In the first swaddling configuration the first fastener being coupled to the second fastener to form a first neck loop for securing the towel around the neck of a caregiver such that the towel depends from the neck of the caregiver and in the second swaddling configuration the third fastener being coupled to the second fastener to form a second neck loop for securing the towel around the neck of a caregiver such that the towel depends from the neck of the caregiver.

It will be apparent that the towels as described herein may be used in a number of different ways. Further, the towels are of relatively simple construction and capable of withstanding normal usage and laundering.

It will also be apparent that the towels as described and illustrated are merely exemplary of the present invention and that various modifications and changes may be made thereto without departing from the scope and spirit of this disclosure.

The foregoing has been a detailed description of illustrative embodiments of the invention. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A swaddling towel configurable in a first swaddling configuration and in a second swaddling configuration, the towel comprising a major dimension and a minor dimension and at least a first, a second and a third fastener provided on the towel for securing the towel around a neck of a caregiver whereby the towel depends from the neck of the caregiver, wherein the first and second fasteners are spaced apart along the minor dimension and the second and third fasteners spaced apart along the major dimension, in the first swaddling configuration the first fastener being coupled to the second fastener to form a first neck loop for securing the towel around the neck of a caregiver such that the towel depends from the neck of the caregiver and in the second swaddling configuration the third fastener being coupled to the second fastener to form a second neck loop for securing the towel around the neck of a caregiver such that the towel depends from the neck of the caregiver.

2. The towel of claim 1, wherein the major and minor dimensions are substantially perpendicular.

3. The towel of claim 1, wherein:

the towel is rectangular and comprises two major edges and two minor edges with major and minor edges joining to form four corners of the rectangle;

the first and second fasteners are each disposed adjacent an opposite corner along one said minor edge; and the third fastener is disposed along a major edge approximately mid-way between two corners.

4. The towel of claim 1, wherein the towel has edges and the edges are rectilinear.

5. The towel of claim 1, wherein the towel comprises a minor edge and the first and second fasteners are provided adjacent the minor edge.

6. The towel of claim 1, wherein the towel comprises a major edge and the third and fourth fasteners are provided adjacent the major edge.

7. The towel of claim 1, wherein the second fastener comprises two separate fasteners, a first second fastener configured to mate with said first fastener and a second second fastener configured to mate with the third fastener.

8. The towel of claim 1, wherein the towel comprises a corner and the second fastener is provided adjacent the corner.

9. The towel of claim 1, wherein the fasteners comprise at least one button and at least one loop.

10. The towel of claim 1, comprising first and second corners and the first and second fasteners are located adjacent the respective first and second corners.

11. The towel of claim 1, comprising at least two layers of different fabrics.

12. The towel of claim 10, comprising a first layer of terry cloth and a second layer comprising cotton.

13. The towel of claim 12, wherein the first layer comprises viscose bamboo rayon.

14. The towel of claim 12, wherein the second layer comprises cotton flannel.

15. A method of swaddling a child in a towel having a major dimension and a minor dimension, and first, second and third cooperating fasteners, with the first and second cooperating fasteners spaced apart along the minor dimension and the second and third cooperating fasteners spaced apart along the major dimension, the method comprising:

(a) securing the towel around the neck of a caregiver using the first and second fasteners such that at least a portion of the towel depends from the neck of the caregiver in the direction of the major dimension and lies against the caregiver's chest;

(b) securing the towel around the neck of a caregiver using the second and third fasteners such that the towel depends from the neck of the caregiver in the direction of the minor dimension and lies against the caregiver's chest;

(c) placing the child against the towel on the caregiver's chest;

(d) folding the towel around the child while secured around the caregiver's neck;

(e) separating the fasteners around the caregiver's neck; and (f) moving the child away from the caregiver while wrapped in the towel:

wherein either of said securing steps (a) or (b) are performed before the other and performance of said securing steps (a) and (b) is spaced apart in time with any of steps (c)-(f) intervening.

16. The method of claim 15, wherein step (d) further comprises folding a lower portion of the towel around the child.

17. The method of claim 15, wherein step (d) further comprises folding a lateral edge of the towel around the child.

18. The method of claim 17, wherein step (f) further comprises lowering the child onto a surface with the child in a standing position.

19. The method of claim 15, further comprising: (g) securing the towel around the neck of the child using the first and second fasteners such that at least a portion of the towel depends from the neck of the child in the direction of the major dimension and lies against the child's back to form a cape.

20. The method of claim 15, further comprising: (h) securing the towel around one of the neck, shoulder and upper arm of a nursing mother to provide a nursing cover.

21. A swaddling towel configurable in a first swaddling configuration and in a second swaddling configuration, the towel being rectangular comprising: first and second minor edges and first and second major edges, the major edges being longer than the minor edges; first and second cooperating fasteners provided on the first minor edge, and third and fourth cooperating fasteners provided on the first major edge, in the first swaddling configuration the first fastener being coupled to the second fastener and forming a first neck loop from the first minor edge for securing the towel around the neck of a caregiver such that the towel depends from the neck of the caregiver with the first and second major edges extending downwardly and in the second swaddling configuration the third fastener being coupled to the fourth fastener and forming a second neck loop from the first major edge for securing the towel around the neck of a caregiver such that the towel depends from the neck of the caregiver with the first and second minor edges extending downwardly.

22. The towel of claim 21, wherein said second and third fasteners are formed by a single fastener.

23. A swaddling towel configurable in a first swaddling configuration and in a second swaddling configuration, said towel comprising:

a fabric rectangle having two major edges and two minor edges with the major and minor edges joining to form four corners of the rectangle having a major dimension and a minor dimension; and fastening means for securing the towel around the neck of a caregiver in said first and second swaddling configurations, said fastening means consisting of three fasteners, wherein said a first fastener of said three fasteners and said a second fastener of said three fasteners are each disposed adjacent an opposite corner along one said minor edge and said a third fastener of said three fasteners is disposed along a major edge approximately mid-way between two corners such that in the first swaddling configuration the first fastener couplable to the second fastener to form a first neck loop for securing the towel around the neck of a caregiver such that the towel depends from the neck of the caregiver and in the second swaddling configuration the third fastener is couplable to the second fastener to form a second neck loop for securing the towel around the neck of a caregiver such that the towel depends from the neck of the caregiver.

24. The swaddling towel of claim 23, wherein said three fasteners comprise a combination of button and button hole fasteners.

25. The swaddling towel of claim 24, wherein said first and third fasteners are loops and said second fastener is a button.

26. The swaddling towel of claim 23, wherein said three fasteners comprise hook and loop fasteners.

27. The swaddling towel of claim 23, wherein said fabric rectangle comprises at least two layers of different fabric materials.

28. The swaddling towel of claim 27, wherein said at least two layers comprise a terry cloth layer and a flannel layer.

* * * * *